US005918395A

United States Patent [19]

Hesmer

[11] Patent Number: 5,918,395

[45] Date of Patent: Jul. 6, 1999

[54] ARTWORK DISPLAY BOX

[76] Inventor: Ronald G. Hesmer, 8004 Bald Eagle La., Wilmington, N.C. 28405

[21] Appl. No.: 08/931,544

[22] Filed: Sep. 16, 1997

[51] Int. Cl.[6] ..... G09F 11/18

[52] U.S. Cl. ..... 40/518; 40/597

[58] Field of Search ..... 40/518, 471, 117, 40/519, 520, 904, 597

[56] References Cited

U.S. PATENT DOCUMENTS

| | | | |
|---|---|---|---|
| 488,134 | 12/1892 | Rogers | 40/518 |
| 1,237,940 | 8/1917 | Morrison | 40/518 |
| 1,729,480 | 9/1929 | Hale | 40/518 |
| 1,896,935 | 2/1933 | Bloomfield et al. | 40/518 |
| 2,485,802 | 10/1949 | Asachika | 40/518 |
| 2,952,931 | 9/1960 | Manduca . | |
| 3,829,997 | 8/1974 | Singer . | |
| 3,928,926 | 12/1975 | Carriveau . | |
| 4,083,136 | 4/1978 | Zelenko | 40/518 |
| 4,277,033 | 7/1981 | Swenson . | |
| 4,310,977 | 1/1982 | Swenson | 40/518 |
| 4,824,140 | 4/1989 | Rankin | 40/518 |
| 5,016,371 | 5/1991 | Aiken . | |
| 5,410,830 | 5/1995 | Aiken, Sr. . | |
| 5,423,140 | 6/1995 | Nuspl | 40/518 |
| 5,515,631 | 5/1996 | Nardy et al. | 40/518 |

*Primary Examiner*—Brian K. Green
*Attorney, Agent, or Firm*—Rhodes, Coats & Bennett, L.L.P.

[57] ABSTRACT

A plurality of paper sheets, such as children's artwork, is displayed and stored by providing a display surface including a display opening; exposing sections of an elongated web in the opening; attaching individual sheets to the exposed web section; winding the web sections and attached artwork around a storage roller while pulling another web section beneath the opening; and placing the storage roller, web and attached artwork into a storage container after all of the web has been wound onto the storage roller.

4 Claims, 3 Drawing Sheets

ARTWORK DISPLAY BOX

BACKGROUND OF THE INVENTION (1) Field of the Invention

The present invention relates generally to an apparatus for displaying children's artwork and other sheet-like items, and in particular to a display box that can be used to display the artwork within a display area, accumulate the artwork, and subsequently store the artwork.

(2) Description of the Prior Art

Every parent has been faced with the pleasure, and sometimes the chore, of displaying the numerous pieces of artwork that their children bring home from school, or otherwise produce for their parents' admiration and approval. Generally, this artwork, which is normally drawn with pencil, paints or crayons on sheets of 8½×11 inch paper, is stuck to a wall or to a refrigerator surface using tape, magnetic fasteners, or other attachment means.

Soon, a new piece of artwork is brought to the parent for approval and display, resulting over time in a cluttered wall or refrigerator, or the need to remove all or some of the older artwork pieces. While an attempt is sometimes made to save the removed artwork by placing the artwork in a drawer or folder, the artwork is often damaged or lost, to the regret of the parents in later years.

Thus, there is a need for a way to neatly display children's artwork, instead of merely sticking it on a wall or refrigerator, and for permanently storing the artwork after it has been displayed.

SUMMARY OF THE INVENTION

The present invention is directed to a system for temporarily displaying children's artwork and other paper sheet material, and for storing the artwork after display. The invention relates especially to a display box that can be mounted on a surface, the box including a display area within which the artwork is displayed, a roller on which the artwork is wound for permanent storage, and a web of material to carry the artwork from the display area onto the storage roller.

More specifically, the display box of the present invention is comprised of a housing that includes an upper surface or wall with a display area, a supply roller support on one side of the display area for supporting a supply roller, and a storage roller support on the opposite side of the display area for supporting a feed roller. When prepared for use, the box also includes a supply roller supported by the supply roller support, a storage roller supported by the storage roller support, and a roll of web wrapped around the supply roller, and extending beneath the display opening to the storage roller.

The display box, after being positioned on a horizontal or vertical surface, is used by placing a supply roller with a roll of web wrapped onto the roller on the supply roller support, and an empty storage roller on the storage roller support. The leading edge of the web is drawn from the supply roller beneath the display opening, and is attached to the supply roller. Alternatively, the web can be positioned onto a fixed supply roller. The first piece of child's artwork is secured, e.g., by adhesive tape, to the surface of the web section positioned exposed in the display opening.

When a new piece of artwork is provided by the child, the storage roller is turned, pulling the web section that is beneath the display area, as well as the attached artwork, around the storage roller, while pulling the next section of web into position beneath the display opening. This procedure is repeated until the entire web and attached artwork has been wound onto the storage roller, and the trailing end of the web is detached from the supply roller.

The storage roller with web and artwork is then withdrawn from the box, and stored in a suitable manner. For example, the full roller can be inserted into a storage tube in which the supply roller was originally purchased. The supply roller and storage roller are then replaced in preparation for the next artwork. Alternatively, the web can be removed from the storage roller and stored separately, with the storage roller being left in place The housing may be of various external configurations for aesthetic purposes. In general, however, the housing will include an upper surface having display opening, a supply roller support at one end of the upper surface, and a storage roller support at the opposite end of the upper surface. The display area will normally be a rectangular opening, with parallel sides and ends. Either the ends or the sides may be parallel to the axes of the supply and storage rollers, depending upon how the artwork is to be displayed. The supports may be in the form of tubular enclosures with an open end, and a web passageway or opening for communication with the area beneath the display opening.

The box may also include parallel side walls extending downward for the opposite sides of upper surface. These side walls will include openings or inlets for inserting the supply and storage rollers into their enclosures or onto other supports. In addition, the box may include a web support surface below the display opening. Also, the box may include at least a partial bottom wall with attachment means thereon for securing the box to a vertical surface, such as a wall or refrigerator door or side. For example, the attachment means may be suction cups, a hook, or a slot for receiving a wall mounted hook.

The supply and storage rollers may include an axle, e.g., a rod or tube, and a handle at one end of the axle to turn the axle. The roller axle includes a means for attaching the leading edge of a web, e.g., a clip or receiving slot. The rollers may also include caps at either end of the axle to align the web on the axle and prevent damage to the web ends. These caps may have a circular periphery, and serve as roller surfaces for supporting the rollers within their enclosures.

Preferably, the supply and storage rollers are of substantially the same construction, allowing the supply roller to subsequently be used as a storage roller. That is, after the web initially carried on the supply roller has been exhausted, the supply roller is inserted into the storage roller enclosure or support, and the leading edge of the web that is carried on the next supply roller is attached, thereby making the supply roller the new storage roller.

The web is preferably of an elongated, acid-free sheet material, so that the artwork or other paper sheets will not be damaged during long term storage. When the supply roller is designed to be used later as a storage roller, only about one-half of the storage capacity of the roller should be wound with web, since some of the capacity will later be required for winding both a web and attached artwork or other paper sheets carried on the web onto the storage roller. Preferably, the web is slightly wider than the distance between the sides of the display area.

Thus, the display box requires a housing, as described above, one empty storage roller, one take-up or storage roller, and a web. In addition, for convenience in storage, the display box should contain a covered holder, e.g., a capped tube for storing the storage roller after it is filled with the web and attached paper sheets. This holder can be used initially as the container for the supply roller and web.

Other configurations of the invention will become apparent to one skilled in the art after reading the above description. For example, instead of constructing the display box exactly as shown above, other housing configurations can be used, e.g., other than rectangular, and without the side walls. Also, the housing components can be integrally formed, or one or more sections can be hinged or removable to facilitate access to the housing interior and to the rollers.

In addition, while less desirable, the supply roller and storage roller can be of different configurations. In this case, the empty supply roller would be discarded, and a new storage roller inserted into the storage roller enclosure when the preceding storage roller is full. The container or holder used to store the filled storage roll can also be eliminated, or a holder of a different type, e.g., a flexible bag, can be used instead of a rigid, capped tubular container. Also, the web can be initially inserted onto the supply roll, and later removed from the storage roller for storing the accumulated artwork.

Accordingly, one aspect of the present invention is to provide a display box comprising a housing having an upper wall with a display opening therein, the display opening having first and second spaced, parallel sides, a supply roller support adjacent the first display opening side, and a storage roller support adjacent the second display opening side; a rotatable supply roller containing a supply of an elongated web supported by the supply roller support; and a rotatable storage roller supported by the storage roller support, the web extending from the supply roller beneath the display opening, and being attached to the storage roller, whereby rotation of the storage roller draws successive sections of the web beneath the display opening for attachment thereto of paper sheets, and wraps the web and previously attached sheets around the storage roller.

Another aspect of the present invention is to provide a system for displaying, accumulating and storing paper sheets of artwork comprising a housing having an upper wall with a display opening therein, the display opening having first and second spaced, parallel edges, a supply roller enclosure adjacent the first display opening side, and a storage roller enclosure adjacent the second display opening side, the enclosures being in communication with the display opening; a rotatable supply roller containing a supply of an elongated web within said supply roller enclosure; a rotatable storage roller within said storage roller enclosure; and a storage container to hold a storage roller wrapped with a web of sheet material and a plurality of artwork sheets.

Still another aspect of the present invention is to provide a method for displaying a plurality of paper sheets by providing a surface including a display opening with first and second opposed sides; providing an elongated web adjacent one of the sides; positioning a storage roller adjacent the other of the sides; connecting the web to the storage roller, with the web extending beneath the opening to expose a section of the web within the opening; attaching a paper sheet to the exposed web section; and winding the exposed web section and attached sheet around the storage roller, while moving another web section beneath the opening.

These and other aspects of the present invention will become apparent to those skilled in the art after a reading of the following description of the preferred embodiment.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
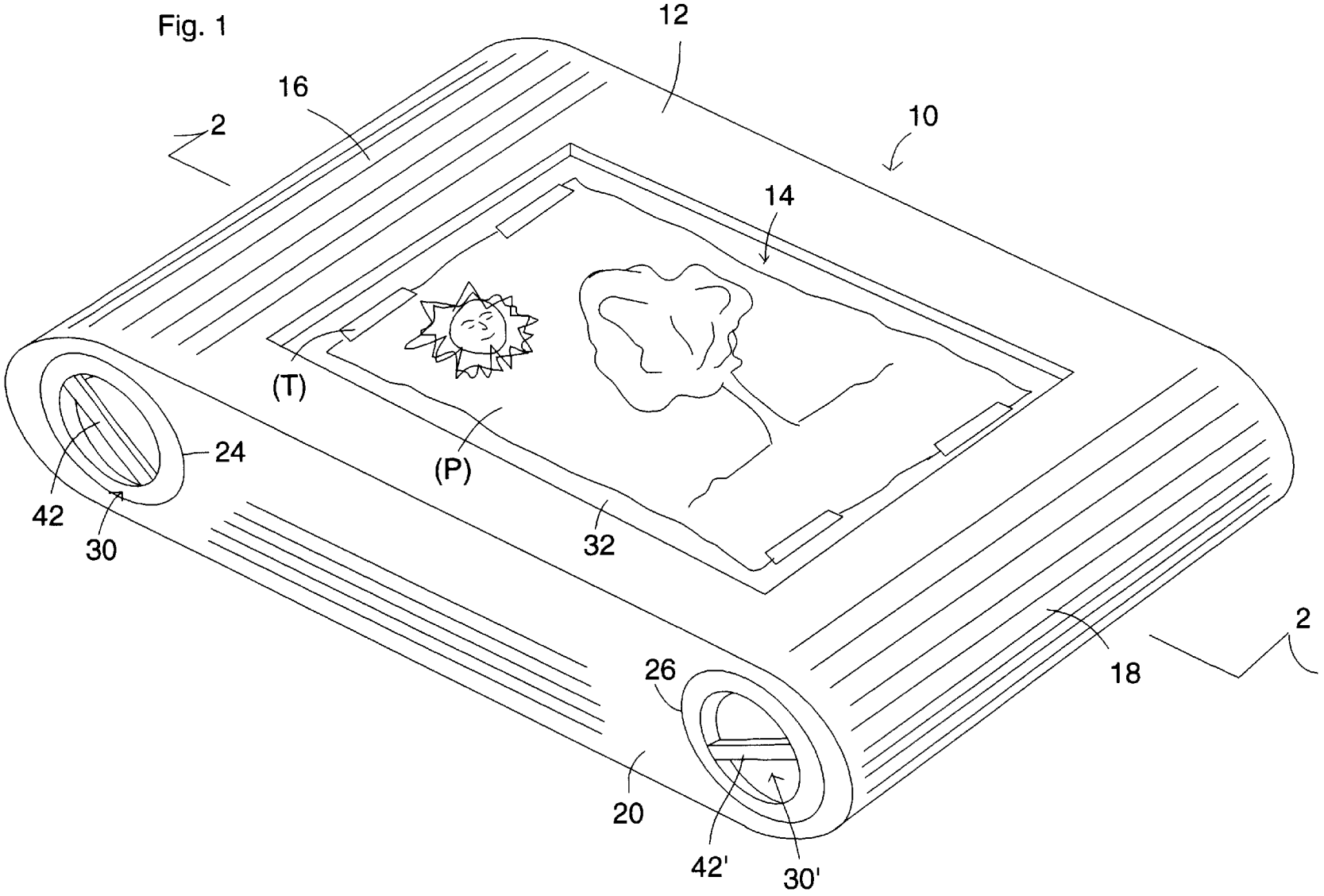
FIG. 1 is a perspective view of the display box.
Figure 2:
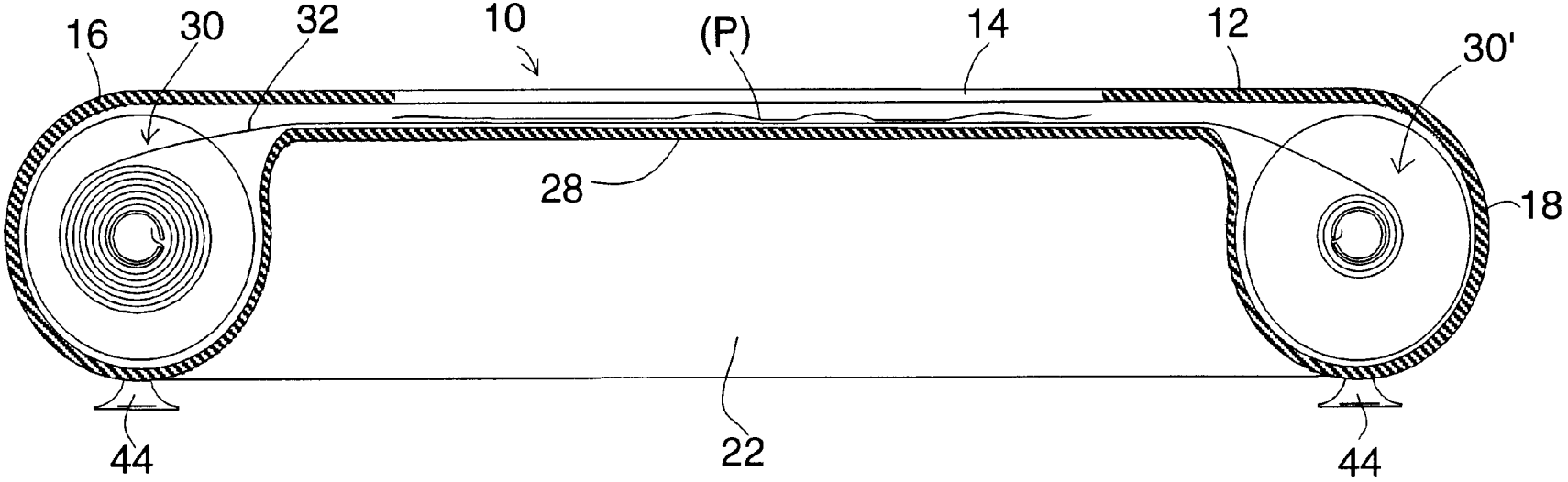
FIG. 2 is sectional side view of the box as seen along line 2—2 of FIG. 1.

As best seen in FIGS. 1 and 2, a preferred embodiment of the display box of the present invention is comprised of a housing, generally 10, which includes a upper wall 12 with a display opening 14; a supply roller enclosure 16 at one end of display opening 14, and a storage roller enclosure 18 at the opposite end of opening 14. Box also includes a side walls 20 and 22 on opposite sides of surface 12. Side wall 20 includes roller inlets 24 and 26. Housing 10 also includes a web support wall 28 spaced beneath opening 14 and parallel to upper wall 12.

A supply roller 30 is shown inserted into enclosure 16 through inlet 24, and a storage roller 30', which is identical to supply roller 30, is shown inserted through inlet 26 into enclosure 18. A web 32 is wound around roller 30 and extends beneath opening 14 to roller 30'.

Figure 3:
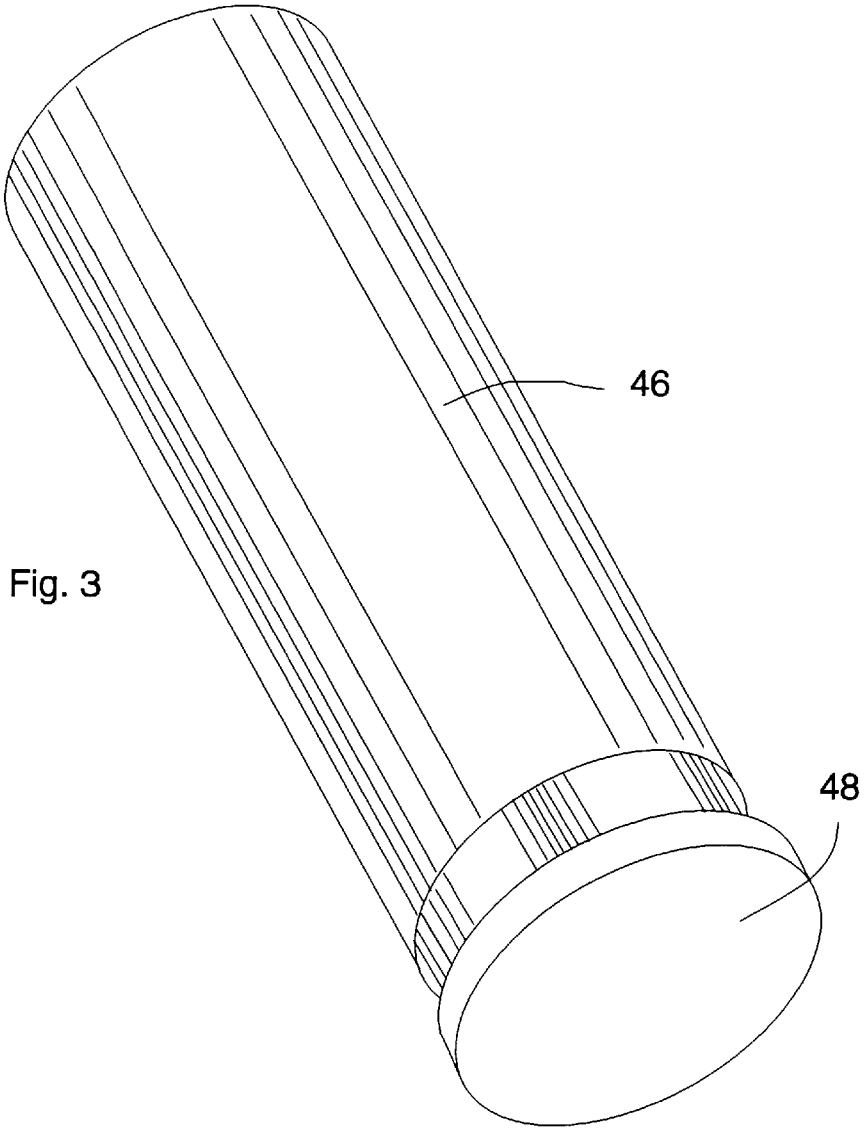
FIG. 3 is perspective view of an empty supply or storage roller.

The roller illustrated in FIG. 3 is designated generally as supply roller 30. It is to be understood, however, that storage roller 30' is of the same construction. Therefore, the description of supply roller 30 applies equally to storage roller 30'. Supply roller 30 is comprised of a central axle 34, shown as tubular in the illustrated embodiment, an inner end cap 36, and an outer end cap 38. Axle 34 includes a slot 40 for attaching an end of web 32. Storage roller 30' includes an equivalent outer end cap 38'. An axle and an inner end cap (both not shown) forms parts of roller 30'.

End cap 38 includes a handle 42 to facilitate rotation of roller 30, especially when roller 30 is later used as roller 30'. It is to be noted that end caps 36 and 38 have circular outer peripheries, so those rollers 30 or 30' can be easily turned within their respective enclosures. Handle 42' on end cap 38' is equivalent to handle 42.

Figure 4:
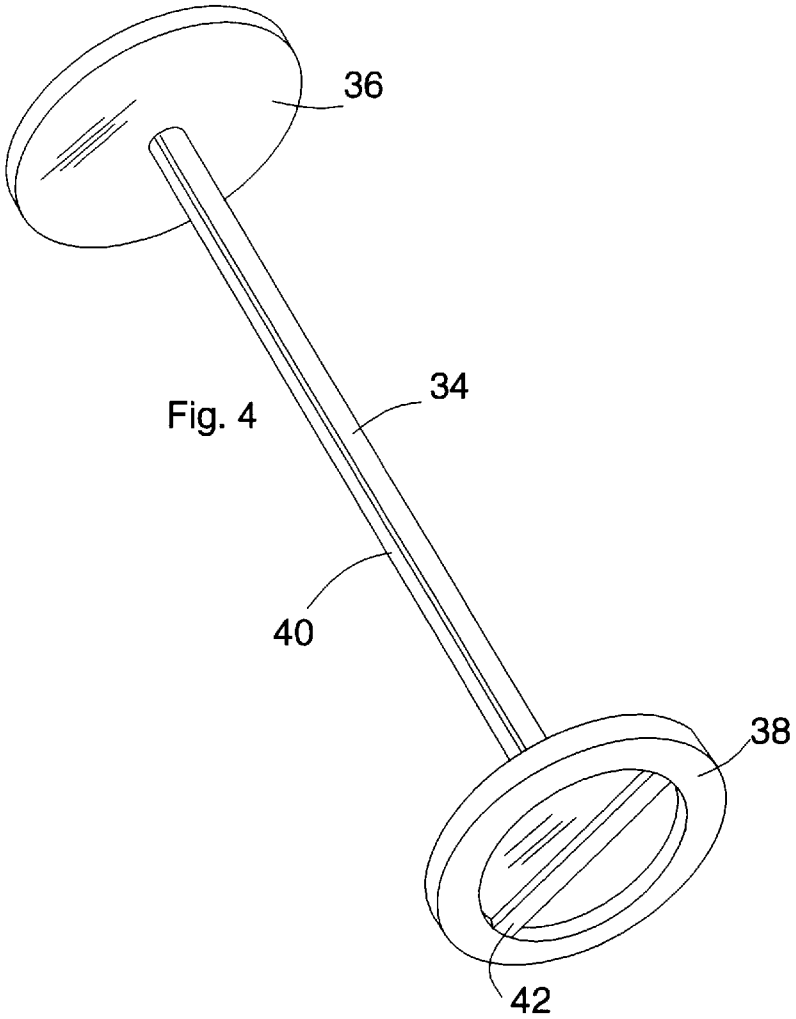
FIG. 4 is a perspective view of a storage holder for a filled storage roller.

The display box also includes suction cups 44 attached beneath housing 10, so that the display box can be removably attached to a vertical surface, such as a wall, or the side or door of a refrigerator. Other attachment means can also be used for this purpose, or the display box can be placed on a horizontal surface. As illustrated in FIG. 4, the system for displaying and storing artwork also includes a storage tube or holder 46, with a removable cap or cover 48, for use in storing full roller 30'.

When used, the display box is positioned at the desired location. Suction cups 44 may be used to position the box vertically. A full supply roller 30 with web 32 wrapped about axle 34 is inserted through inlet 24 into enclosure 14, and an empty storage roller 30' is inserted into enclosure 18. The leading edge of web 32 is then unwound from roller 30 and attached to roller 30'. When a picture (P) is to be displayed, the picture is secured to the exposed surface of web 32 within display opening 14, e.g., with adhesive tape (T).

When display of a new picture is desired, handle 42' is turned to rotate roller 30', wrapping the previously displayed picture and web section around roller 30' and exposing the next section of web 32 for attachment and display of the next picture. This procedure is repeated until all of web 32 has been withdrawn from supply roller 30, and wrapped onto roller 30' along with the attached pictures.

Filled roller 30' with web 32 and the pictures wrapped around its axle are withdrawn form enclosure 18 and inserted into holder 46. Cover 48 is then placed over the end of holder 46, and the holder is stored. Empty supply roller 30 is removed from enclosure 16 and inserted into enclosure 18 to serve as new storage roller 30'. A new filled supply roller 30 is inserted into enclosure 16, and the procedure is repeated.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A method for displaying and storing a plurality of paper sheets comprising:

a) providing a display box including a housing having an upper wall with a display opening having first and second spaced, parallel sides, a supply roller support adjacent one display opening side, a storage roller support adjacent the other display opening side, and a support wall spaced beneath said display opening between said roller supports;

b) providing a rotatable supply roller supported by said supply roller support;

c) providing a rotatable storage roller supported by said storage roller support;

d) attaching an elongated web from said supply roller beneath said display opening, across said support wall and to said storage roller, up to about one-half of the storage capacity of said supply roller being initially used by said web, said web being accessible through said opening;

e) rotating said storage roller to pull successive sections of said web beneath said display opening and above said support wall;

f) attaching paper sheets through said opening to successive sections of said web; and g) wrapping web sections and attached paper sheets around said storage roller, said storage roller having a capacity sufficient to hold said web and attached sheets.

2. The method of claim 1, further comprising the step of placing said storage roll, web and attached sheets into a storage container after all of said web has been wound onto said storage roller.

3. The method of claim 1, including providing said elongated web in roll form around a supply roller, said supply roller having the same construction as said storage roller.

4. The method of claim 1, further comprising the step of replacing said storage roller with said supply roller after all of said web has been wound onto said storage roller.

* * * * *